United States Patent [19]

Martin

[11] 4,191,174

[45] Mar. 4, 1980

[54] INCUBATOR OPENINGS

[76] Inventor: Paul F. Martin, 86 Townsend Rd., Miramar, Wellington, New Zealand

[21] Appl. No.: 860,085

[22] Filed: Dec. 13, 1977

[30] Foreign Application Priority Data

Dec. 20, 1976 [NZ] New Zealand ..... 182924

[51] Int. Cl.[2] ..... A61G 11/00

[52] U.S. Cl. ..... 128/1 B; 98/115 LH; 128/205.26

[58] Field of Search ..... 128/1 B, 1 R, 204, 298, 128/191 A, 145 R, 142.3, 28, 205; 98/121 R, 115 LH, 32; 62/265; 119/31, 15, 37–40, 21

[56] References Cited

U.S. PATENT DOCUMENTS

| | | | |
|---|---|---|---|
| 2,246,820 | 6/1941 | Taylor | 128/1 B |
| 3,782,362 | 1/1974 | Puzio | 128/1 B |
| 4,026,286 | 5/1977 | Trexler | 128/204 |

FOREIGN PATENT DOCUMENTS

| | | |
|---|---|---|
| 1167603 | 10/1969 | United Kingdom . |
| 1271037 | 4/1972 | United Kingdom . |
| 1405477 | 9/1975 | United Kingdom . |

*Primary Examiner*—Henry J. Recla
*Attorney, Agent, or Firm*—Holman & Stern

[57] ABSTRACT

An incubator which includes an opening which includes inwardly directed canopy like flanges or the equivalent so that upon the opening of the opening preferably using a slide door, air or oxygen from the controlled environment of the incubator can exit without a tendency for cold air to roll in over the bottom edge of the opening. To enhance this effect the incubator is of a type that allows a certain amount of leakage of the life support fluid even when the opening is ostensibly closed.

6 Claims, 7 Drawing Figures

INCUBATOR OPENINGS

CROSS-REFERENCES TO RELATED APPLICATIONS

This application is based on my New Zealand patent application No. 182,924 filed on Dec. 20, 1976. That patent specification included two inventions of which the present invention is but one. The second invention relates to incubator environment control using removable humidifying means in such a way that noise levels and infection levels in the incubator space per se can be substantially reduced. A person wishing to employ the present invention is referred to this divisional application which is being filed simultaneously herewith.

BACKGROUND OF THE INVENTION

1. Field of the Invention

The present invention relates to improvements in or relating to incubators, and in particular, although not solely to an access opening for an incubator for human babies which is capable of being used without seriously affecting the incubated environment.

DESCRIPTION OF THE PRIOR ART

Modern incubators at hospitals are complex machines which are adapted to maintain the premature or sickly baby in a controlled environment. It is standard nowadays for not only the temperature to be controlled by also the humidity and oxygen content of the air which is passed through the chamber in which the baby rests. The control of the environment within incubators is not as accurate as should ideally be required. For example, see the range of limits set out in British Standard 3061:1965 where a thermostatically controlled incubator should have a "steady temperature condition" which is defined as a condition when the temperature in the baby compartment does not vary more than 1° C. over a period of 1 hour and the average temperature does not vary by more than 0.2° C. during this period. This requirement is difficult to meet with air loss during a period for which an access opening is being used.

BRIEF SUMMARY OF THE INVENTION

In order to overcome difficulties which arise with conventional closed environmental incubators the present invention is primarily adapted for use with incubators of a type which allow a certain amount of leakage from the incubator space. This is especially the case with an incubator that does not recirculate the life support fluid. Such controlled leakage incubators are known, however even so, they are not completely successful in allowing the opening and closing of the opening without afffecting the incubated environment owing to a rolling over effect by air from outside the opening that occurs.

Accordingly in one aspect the present invention consists in an incubator which includes means defining an opening into said incubator and means providing an inwardly directed canopy over said opening.

Preferably said canopy extends downwardly at least partly on either side of said opening and preferably said canopy projects inwardly more over the opening than it does at points on either side of said opening. Preferably there is no part of said canopy which projects inwardly underneath said opening. Also the canopy which is preferably in the form of a flange projects downwardly from said means defining an opening.

In a further aspect the present invention consists in means defining an access opening in the surround of a baby's incubator which includes about the opening at least one inwardly directed flange with the construction and arrangement being such that the extent of the protrusion of said flange is the greatest substantially at the top of said opening and is minimal if not non-existent at the bottom thereof.

In still a further aspect the invention consists in a baby's incubator which includes means defining an opening in accordance with the present invention. Preferably said opening is combined with a sliding door.

In yet a further aspect the invention consists in an incubator which includes means defining an opening in the incubation space of said incubator, said means providing said opening with a greater depth of surround at upper regions than at lower regions.

BRIEF DESCRIPTION OF SEVERAL VIEWS OF THE DRAWINGS

One preferred form of the present invention will now be described with reference to the accompanying drawings in which:

FIG. 4 shows the air flow movement through a conventional opening, while

Figure 2:
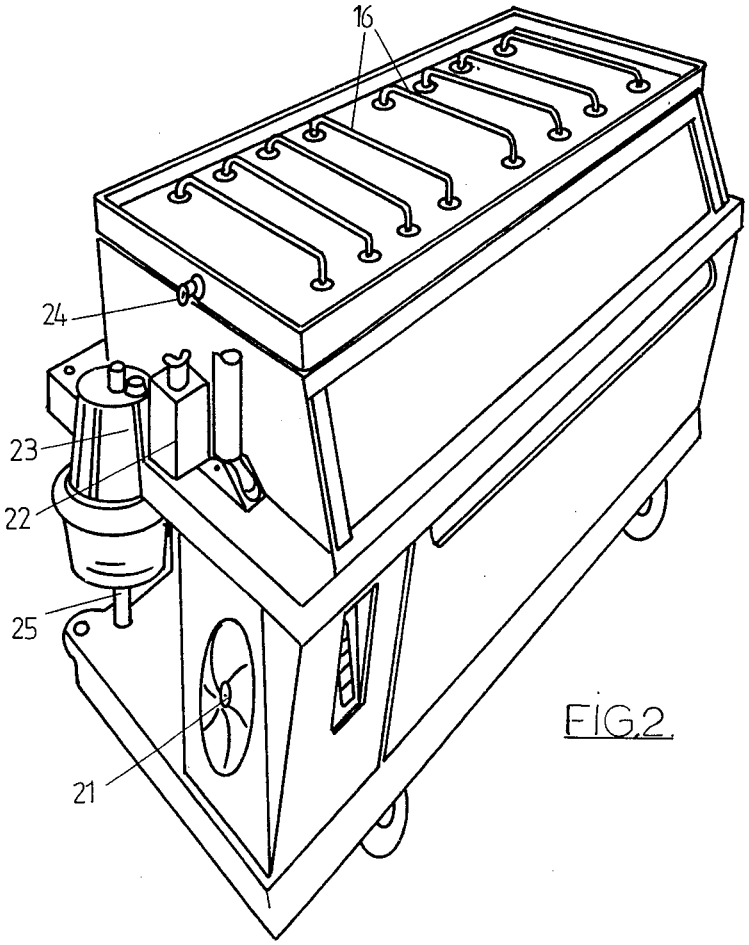
FIG. 2 shows the frame of the incubator in a partly disassembled form.
Figure 4:
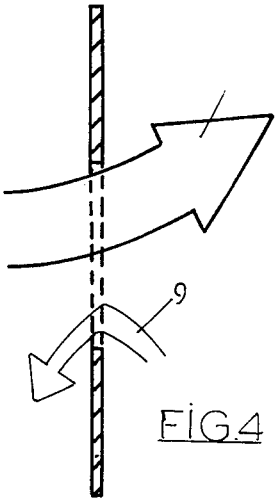
Figure 5:
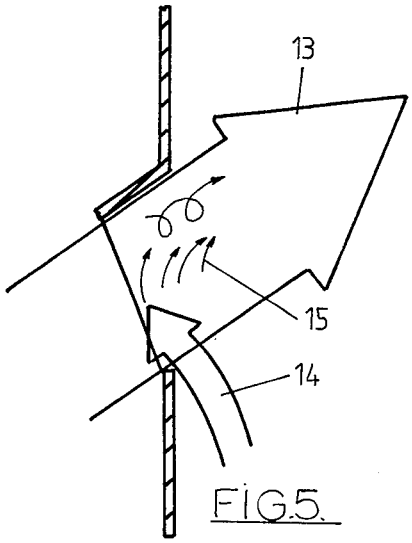
FIG. 5 shows the air movement through an opening of a kind as shown in FIG. 3.

In the preferred form of the present invention an incubator housing or base substantially as shown in FIG. 2 is provided. This is a mobile member formed from a metal capable of being easily cleaned although there may well be plastics inclusions. The size of the housing is such that the bed support which will be located on the top thereof will be at a convenient height for a nurse. Moreover the actual scope of the housing is such that the whole structure is stable even when being moved and is still capable of containing the electronics and miscellaneous paraphernalia necessary for the efficient use thereof. Moreover spare parts and the like can be included therin. Also for example a horizontal elongate opening could be provided to allow easy access for the X-ray film and the like underneath the bed support surface. However, such refinements need not be discussed in detail as it is the inventive features of the incubator of the present invention that is of importance. The preferred form of the incubator comprises the base portions 1 and a top or cover 2, preferably the top being formed from a transparent material such a perspex. The top 2 is hinged (preferably removably) along one longitudinal edge 3 to the base with the hinging allowing the cover as desired to be lifted away from over the housing or body 1. When the same is so moved some pneumatic ram or the like arrangement 4 dampens the movement thereof so that the same will not under any circumstances fall dangerously. Moreover a side wall 5 is provided with a hinged base portion 6 so that that too can be pulled away from adjacent the bed support surface. This too, is movable under some damping or controlled pivot arrangement, even the pivot line is movable. The cover 2 includes therein a plurality of openings 7, of which only one is shown in the drawing as having a sliding cover located thereover, i.e. 8. Provision of the sliding cover is such that the opening and closing of a cover over an access opening will be less likely to interfere with air movements and hence conditions of the environment within the enclosed baby chamber. To avoid an air flow situation as shown in FIG. 4 where cold air 9 rolls from the outside into the baby chamber while hot air 10 moves out an inwardly directed flange 11 is provided which overhangs most at or adjacent the top while along the sides of the opening it gradually decreases. Smoke tests have shown that an air flow as shown in FIG. 5 occurs with whatever hot air 13 inevitably lost interferring with cold air 14 which is prevented from rolling in at the base of the opening by virtue of the turbulence in which it is embroiled as shown by arrows 15 in the drawings. It can be seen therefore that if the air and/or oxygen flow into a baby chamber in an incubator of the present invention is such that there is a pressure differential from the inside to the outside cold unsterilized air is substantially prevented from entering the baby chamber and hence endanger the life of any baby contained therein.

Figure 1:
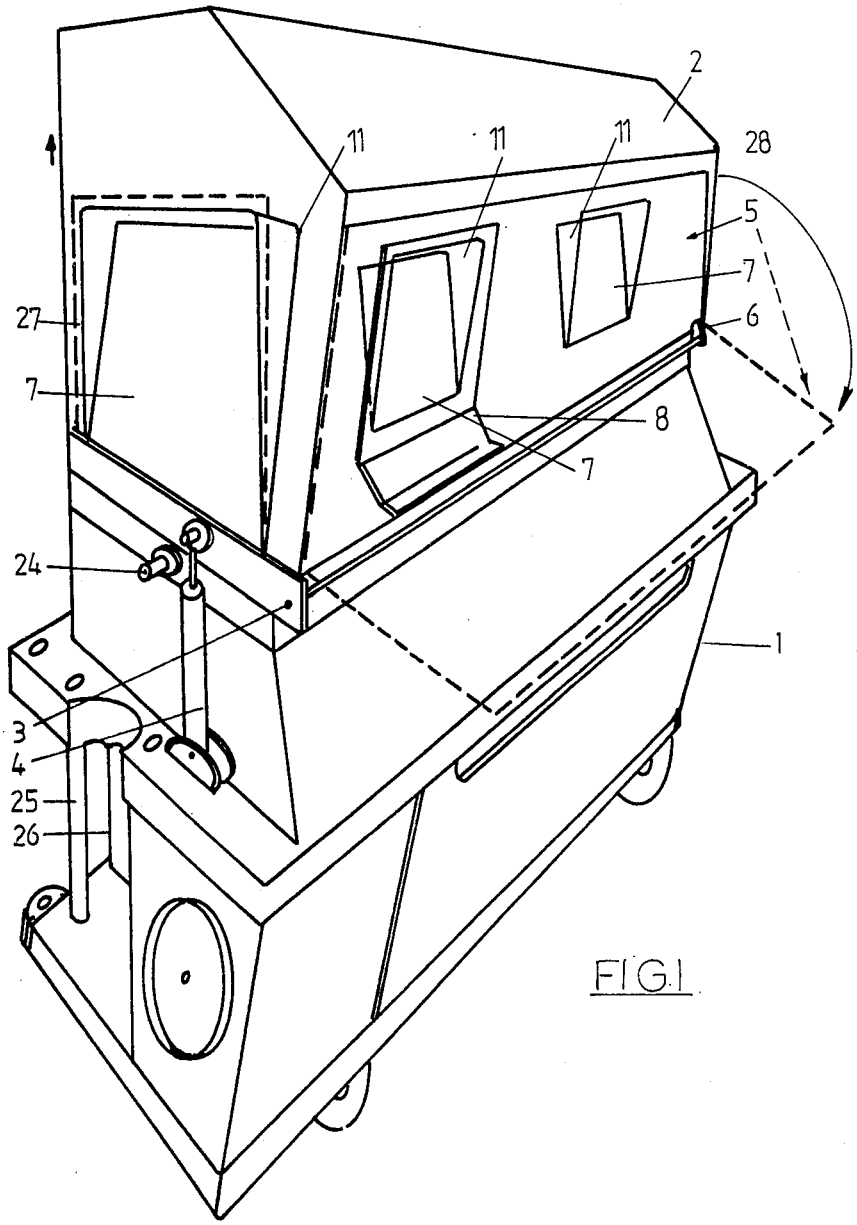
FIG. 1 is a perspective view showing most of the componentry of an incubator in accordance with the preferred form of the present invention.
Figure 6:
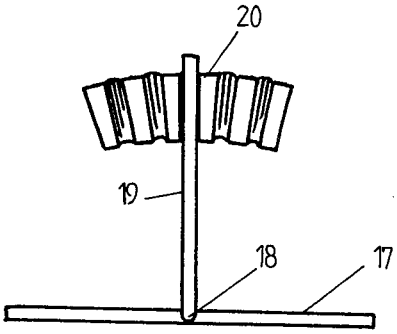
FIG. 6 shows the means for adjusting the inclination of a bed support plate in accordance with the present invention in a diagrammatic view.
Figure 3:
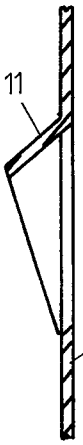
FIG. 3 shows an opening in accordance with the present invention.
Figure 7:
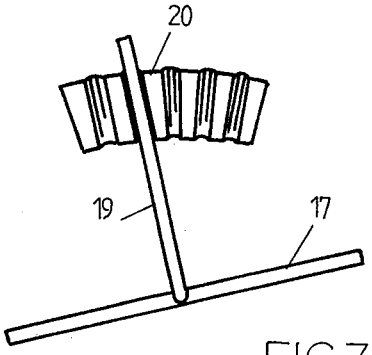
FIG. 7 shows the same apparatus showing how the rigid linkage attached to the bed support plate or the pivot thereof can be locked at a different position in order to hold the bed support plate at a different inclination.

The incubator of the present invention is unique in the sense that it provides all of the requirements of the modern incubator but without the use of water tanks, water heaters and fan unit contained within the base or housing. The means capable of being heated in accordance with the present invention are a plurality of electrical elements 16 which a disposed along the top of the base. These are actuable at the control of a temperature sensor positioned some place within the baby chamber. Mounted above the elements 16 but not in heat conductive contact therewith in the preferred form of the present invention is a metal plate, for example aluminium. This metal plate is the bed or bedding supporting surface or at least is one component thereof. The same is preferably pivotted at a central point as shown in FIG. 6 and 7. Here the plate 17 has a central pivot or pivot line 18 to which or otherwise connected thereto is a rigid linkage 19 which in the preferred form of the present invention is an arm member. This arm member can be moved and engaged with rebates or the like 20 in some locating plate positioned either above or below the bed support plate 17. It can be seen therefore that no complicated screwing or winding mechanisms are needed to adjust the inclination of a baby within the baby chamber. In fact in order to adjust the inclination, it is not necessary to interfere with the cover of the incubator at all. While this tilting mechanism is not shown in FIG. 1, a person skilled in the art will appreciate how the same could be located in conjunction therewith without interfering without any of the movements of the cover. Also, it will be appreciated that if severe tilts are to be obtained, that the bed support surface plate 17 should be positioned some distance above the electrical elements 16.

The feature of the present invention which allows the use of simple heating means such as shown in FIG. 2 is the provision of a fan 21 which is capable of drawing in air externally of the machine for ducting firstly through a bacteriological filter 22 (the ducting not being shown) and if desired through a humidification unit 23 and from thence by ducting which is not shown through a port member 24 (preferably mounted on a removable rim for ease of cleaning access to majority of base top) into a chamber defined beneath the bed support plate 17 from whence the air will pass in an heat transfer manner adjacent the electrical elements 16 and from there to issue into the baby chamber proper which is underneath the cover 2 and above the support plates 17. The humidification unit 23 is a Fisher and Paykel "328" humidification unit as disclosed in DESIGNSCAPE No. 85 October 1976, published by the New Zealand Industrial Design Council at page 24 and as described and claimed in New Zealand Pat. No. 183,517. The same can be pivotted on a support pole 25 which allows the same to be lowered and swung into the region 26 of the incubator.

A feature that allows the easy sterilization of the incubator is the fact that most, if not all, of the servicing arrangements that require frequent sterilization are external of the baby chamber and hence only areas of the incubator which are in bacteriological contact upstream with respect to the baby's compartment from the bacteriological filter need to be sterilized. There is no need whatsoever to completely strip the unit as is the case with most conventional incubators although provision is made therefor.

From the foregoing then it can be seen that the preferred construction of the present invention provides a readily sterilized unit whereby a baby is kept at optimum conditions owing to the fact that access can be made thereto without significantly interfering with the environment therein. It is found that with an air flow into the baby chamber of only about 10 liters per minute the flow characteristics shown in FIG. 5 occur with the air flow not being too much to make economical use of any oxygen which is to enrich the air flow if required. A person skilled in the art will understand how various conduits and the like could be provided to duct the air from the fan and to mix the same with enriching oxygen as required.

It has been found with conventional incubators noise is a great problem. This has not hitherto been treated as such as it has only recently been determined that infrasound can lead to significant hearing loss in babies subjected to a prolonged period in an incubator. The big difficulty with conventional systems is the fact that the humidifier, heater and fan are all closely related to the environmentally controlled space which result in fan noise and vibrations giving rise to sound generation within that space. The present invention however embodies the use of a controlled leakage type incubator which includes readily removable ancillary apparatus, i.e. filters, and humidifier which are interposed between the fan on a duct so as to minimise sound levels passing to the environmentally controlled space. Ideally the fan is located as far as possible from the environmentally controlled space and there is a sound damping effect created by the appropriate choice of filter, humidifier and heating means.

It will be noted also that the apparatus provides many access openings to ease the servicing of a baby. Moreover with the provision of a bedding support plate 17 of the present invention the inclination can readily be adjusted. Also with such supporting plates 17, provision can be made to make the bedding on which the baby is supported slidable relative thereto, e.g. in a longitudinal and/or a lateral direction with respect to the plate 17 while the cover 2 remains closed and located on the base. Of course also a large opening could be provided in the cover 2, for example at one side as shown in dotted lines 27 or at one end 28 which would allow the baby to be pulled from the closed environment with or without its bedding temporarily for any particular reason and returned thereto with a minumum of change in its ambient condition.

Further constructional features of the preferred form and the advantages thereof can be gleaned from a perusal of an article on it in DESIGNSCAPE No. 92, June 1977, published by the New Zealand Industrial Design Council at pages 17 to 20.

From the foregoing then it will be seen that the preferred form of the present invention embodies a host of features not hitherto employed in incubators which should therefore guarantee that with all its advantages an incubator of the present invention should find ready acceptance.

What I claim is:

1. An incubator including a cover means and means cooperating with said cover means for defining an enclosure within said cover means having sides and a top, means defining at least one access opening in a side of said cover means for allowing at least a person's arm to be extended through said side into said enclosure, said access opening having top, bottom, and side portions, rigid means movably disposed to the outside of said cover means to allow for opening and substantial closing of said access opening, means for providing said enclosure with an environment having a gas pressure above that externally of said enclosure, said means defining said at least one access opening including self-supporting canopy-like flange means projecting inwardly and downwardly of said enclosure at the top portion of said access opening and extending at least along upper parts of said side portions of said access opening, said flange means extending further into said enclosure at upper regions of said flange means than at lower regions of said flange means whereby, opening said access opening will not allow any substantial rolling over by air from outside the access opening into said enclosure to hence affect the incubator environment.

2. The incubator as defined in claim 1, wherein said flange means terminates adjacent said bottom portion of said access opening.

3. The incubator as defined in claim 1 wherein said flange means extends into said enclosure a maximum distance at a top region thereof and progressively decreases in the amount of inward projection from said top region to a botton region thereof, said flange means terminating adjacent said bottom portion of said access opening.

4. The incubator as defined in claim 1 wherein said access opening is substantially rectangular in shape.

5. The incubator as defined in claim 1 wherein said rigid means is a sliding door.

6. The incubator as defined in claim 5 wherein said sliding door when in the substantial closing condition provides a non-airtight closure of said access opening.

* * * * *